US009365045B2

(12) United States Patent
Shibata

(10) Patent No.: US 9,365,045 B2
(45) Date of Patent: Jun. 14, 2016

(54) INKJET RECORDING DEVICE

(71) Applicant: FUJIFILM Corporation, Tokyo (JP)

(72) Inventor: Hiroshi Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/857,026

(22) Filed: Sep. 17, 2015

(65) Prior Publication Data

US 2016/0001566 A1 Jan. 7, 2016

Related U.S. Application Data

(63) Continuation of application No. PCT/JP2014/056297, filed on Mar. 11, 2014.

(30) Foreign Application Priority Data

Mar. 21, 2013 (JP) ..... 2013-057593

(51) Int. Cl.
*B41J 2/18* (2006.01)
*B41J 2/175* (2006.01)
*B41J 2/19* (2006.01)

(52) U.S. Cl.
CPC ..... *B41J 2/17566* (2013.01); *B41J 2/175* (2013.01); *B41J 2/18* (2013.01); *B41J 2/19* (2013.01)

(58) Field of Classification Search
USPC ..... 347/14, 11, 90, 89, 85, 86
See application file for complete search history.

(56) References Cited

U.S. PATENT DOCUMENTS 4,301,459 A * 11/1981 Isayama ..... B41J 2/19 347/19
4,825,228 A * 4/1989 Gloeckler ..... B41J 2/195 137/398
6,179,406 B1 * 1/2001 Ito ..... B41J 2/1707 347/35
6,224,201 B1 * 5/2001 Shigemura ..... B41J 2/175 347/93
6,234,597 B1 * 5/2001 Suzuki ..... B41J 2/175 347/19

(Continued)

FOREIGN PATENT DOCUMENTS

JP H11-334104 A 12/1999
JP 2005-193623 A 7/2005

(Continued)

OTHER PUBLICATIONS

Notification of Transmittal of Translation of the International Preliminary Report on Patentability and Translation of Written Opinion of the International Searching Authority; PCT/JP2014/056297; issued on Oct. 1, 2015.

(Continued)

*Primary Examiner* — Matthew Luu
*Assistant Examiner* — Lily Kemathe
(74) *Attorney, Agent, or Firm* — Studebaker & Brackett PC

(57) ABSTRACT

An inkjet recording device includes: a head; an ink tank which is connected with the head through a supply channel and a collection channel; a deaeration module which is provided on a side of the supply channel; a main tank; and a supply control unit which controls supply and collection of the ink, where: a supplement flow rate from the main tank to the ink tank is assumed as L1 (ml/sec), a consumption flow rate of ejection from the head is assumed as L2 (ml/sec), and, in the case of L1<L2, print time limit n is calculated by equation: $n \leq (\Delta T/L2)+[T_0/(L2-L1)]$; and, when printing does not end within the print time limit n, the printing is interrupted and the ink is deaerated by circulating the ink.

5 Claims, 6 Drawing Sheets

(56) References Cited

U.S. PATENT DOCUMENTS 6,302,516 B1 * 10/2001 Brooks ..... B41J 2/175 347/35
6,814,432 B2 * 11/2004 Yamada ..... B41J 2/175 347/85
6,995,858 B2 * 2/2006 Murakami ..... B41J 2/17566 358/1.14
7,416,294 B2 * 8/2008 Kojima ..... B41J 2/04508 347/92
7,699,451 B2 * 4/2010 Nishida ..... B41J 2/17596 347/85
8,152,263 B2 * 4/2012 Nishizaka ..... B41J 2/17509 347/14
8,201,934 B2 * 6/2012 Kawakami ..... B41J 2/175 347/100
8,235,518 B2 * 8/2012 Cornell ..... B41J 11/002 347/102
8,353,565 B2 * 1/2013 Saikawa ..... B41J 2/17506 347/19
8,353,570 B2 * 1/2013 Ishikawa ..... B41J 2/2132 347/14
8,366,224 B2 * 2/2013 Yokota ..... B41J 2/14233 347/7
8,371,687 B2 * 2/2013 Tojo ..... B41J 2/14233 347/100
8,403,439 B2 * 3/2013 Tanaka ..... B41J 2/175 347/17
8,434,844 B2 * 5/2013 McAvoy ..... B41J 2/04508 347/12
8,449,087 B2 * 5/2013 Kataoka ..... B41J 2/18 347/84
8,556,368 B2 * 10/2013 Rosati ..... B41J 2/175 347/14
8,931,891 B2 * 1/2015 Shifley ..... B41J 11/002 347/101
9,102,157 B2 * 8/2015 Prothon ..... B41J 2/175
9,102,163 B2 * 8/2015 Shibata ..... B41J 2/19
9,221,265 B2 * 12/2015 Vodopivec ..... B41J 2/175
9,272,522 B1 * 3/2016 Kosaka ..... B41J 2/17566
2002/0105565 A1 * 8/2002 Suda ..... B41J 2/17506 347/85
2002/0113852 A1 * 8/2002 Kimura ..... B41J 2/175 347/85
2003/0058297 A1 * 3/2003 Saruta ..... B41J 2/17513 347/19
2003/0210309 A1 * 11/2003 Kimura ..... B41J 2/175 347/85
2003/0227524 A1 * 12/2003 Yamada ..... B41J 2/175 347/85
2005/0134659 A1 * 6/2005 Suda ..... B41J 2/17503 347/85
2008/0211841 A1 * 9/2008 Kojima ..... B41J 2/175 347/9
2008/0278558 A1 * 11/2008 Kojima ..... B41J 2/04508 347/92
2009/0046132 A1 * 2/2009 Izawa ..... B41J 2/16523 347/85
2009/0051722 A1 * 2/2009 Kaiho ..... B41J 29/38 347/17
2009/0219320 A1 * 9/2009 Shimizu ..... B41J 2/055 347/14
2010/0085396 A1 * 4/2010 Yokota ..... B41J 2/14233 347/7
2010/0097420 A1 * 4/2010 Nishizaka ..... B41J 2/17509 347/14
2010/0182365 A1 * 7/2010 Kayanaka ..... B41J 2/175 347/14
2010/0207981 A1 * 8/2010 Ishikawa ..... B41J 2/2132 347/14
2010/0225696 A1 * 9/2010 Shibata ..... B41J 2/04553 347/17
2010/0259575 A1 * 10/2010 Uptergrove ..... B41J 2/175 347/14
2011/0074840 A1 * 3/2011 Nishimura ..... B41J 2/175 347/6
2011/0211004 A1 * 9/2011 Munakata ..... B41J 2/15 347/14
2012/0007902 A1 * 1/2012 Hiratsuka ..... B41J 2/175 347/7
2012/0024395 A1 * 2/2012 Furukawa ..... B41J 2/175 137/14
2012/0033003 A1 * 2/2012 Tanaka ..... B41J 2/175 347/6
2014/0063088 A1 * 3/2014 Shibata ..... B41J 2/19 347/6
2015/0174897 A1 * 6/2015 Arimoto ..... B41J 2/175 347/6
2016/0052259 A1 * 2/2016 Sugitani ..... B41J 2/04586 347/17

FOREIGN PATENT DOCUMENTS

JP 2009-291978 A 12/2009
JP 2010-083021 A 4/2010
JP 2011-088437 A 5/2011

OTHER PUBLICATIONS

International Search Report and Written Opinion of the International Searching Authority, PCT/JP2014/056297, Jun. 10, 2014.

* cited by examiner

RELATED ART

INKJET RECORDING DEVICE

CROSS-REFERENCE TO RELATED APPLICATIONS

This application is a Continuation of PCT International Application No. PCT/JP2014/056297 filed on Mar. 11, 2014, which claims priority under 35 U.S.C §119(a) to Japanese Patent Application No. 2013-057593 filed on Mar. 21, 2013. Each of the above applications is hereby expressly incorporated by reference, in their entirety, into the present application.

BACKGROUND OF THE INVENTION

1. Field of the Invention

The present invention relates to an inkjet recording device, and particularly relates to an inkjet recording device including a circulation channel that circulates in an ejection unit and storage unit of liquid.

2. Description of the Related Art

Recently, a demand for printing with a small number of copies has grown in the printing industry. Since it is necessary to make a plate in offset printing, there is a problem in respect of time and costs when printing with a small number of copies is performed. Therefore, inkjet recording of a single-pass system is suitably used.

However, in the single pass system, there is a fault that, when a nozzle that does not perform ejection or a nozzle with ejection bending exists, a stripe is remarkable in the lack part. As a factor to cause the stripe, air bubbles mixed in a head (the rise of a dissolved oxygen amount) are a large factor. By installing a deaeration module in a circuit to remove the air bubbles, the dissolved oxygen amount in ink is kept at a low level during circulation by the deaeration module. However, when deaerated ink is consumed by printing, non-deaerated ink is supplemented from a main tank and the dissolved oxygen amount during circulation increases.

Japanese Patent Application Laid-Open No. 11-334104 (PTL 1) listed below describes an inkjet printer that avoids defective printing by ink ejection unstability by stopping printing when detecting that ink in an ink tank decreases to be equal to or less than a predetermined amount or by forcibly stopping printing when it is over a defined print number limit.

SUMMARY OF THE INVENTION

However, the inkjet printer described in PTL 1 merely stops printing, and it is not discussed that a stripe does not occur in an image formed by the rise of a dissolved oxygen amount.

The present invention is made in view of such circumstances, and it is an object to provide an inkjet recording device that can form an image of high quality by maintaining the dissolved oxygen amount of ink during printing to a low level.

To achieve the object, the present invention provides an inkjet recording device including: an ejection head in which an ejection port to eject ink is formed; an ink tank which is connected with the ejection head through a supply channel and a collection channel and houses the ink supplied to the ejection head through the supply channel and collected from the ejection head through the collection channel; a deaeration module which is provided on a side of the supply channel and deaerates the ink; a main tank which is connected with the ink tank through a supplement channel and in which the ink supplied to the ink tank through the supplement channel is stored; a liquid level sensor which is provided in the ink tank and detects ink in the ink tank; a supply control unit which controls supply and collection of the ink; and a drawing control unit which controls ejection of the ink and performs image formation, where: the supply control unit supplements the ink from the main tank to the ink tank at supplement flow rate L1 (mL/sec) when the liquid level sensor detects that an ink amount in the ink tank is equal to or less than a lower limit value, and interrupts supplement of the ink when the ink amount in the ink tank becomes an upper limit value; a consumption flow rate of the ink ejected from the ejection head is assumed as L2 (ml/sec), an amount of the ink in the ink tank before a start of printing is assumed as T (ml), an ink amount of a lower limit value detected by the liquid level sensor in the ink tank is assumed as $T_0$ (ml), a used amount up to detection in the liquid level sensor from amount T of the ink in the ink tank before the start of printing is assumed as $\Delta T$ ($=T-T_0$) (ml), and, in a case of $L1<L2$, print time limit n (sec) is calculated by equation (1), $n \leq (\Delta T/L2)+[T_0/(L2-L1)]$ . . . (1); and, when printing does not end within the print time limit n, the printing is interrupted within the print time limit n, and the ink is deaerated by circulating the ink between the ink tank and the ejection head.

According to the present invention, when the consumption flow rate is assumed as L2 and the supplement flow rate from the main tank to the ink tank is assumed as L1, in the case of $L1<L2$, the print time limit is calculated by abovementioned equation (1). The print time limit is calculated, and, in a case where printing exceeds this print time limit, printing is interrupted and deaeration is performed. Since deaerated ink is stored in the ink tank in the print time limit, the dissolved oxygen amount can be maintained at a low level as a whole in the ink tank even if non-deaerated ink is supplemented from the main tank, and therefore it is possible to suppress the occurrence of stripes in a formed image.

In a case where printing exceeds the print time limit n, since deaerated ink from the main tank is stored in the ink tank, a stripe is likely to occur in a formed image. Therefore, in the present invention, since printing is interrupted and ink is deaerated before this print time limit n is exceeded, it is possible to eject a function liquid in a state where the dissolved oxygen amount of the function liquid ejected from the ejection head is maintained at a low level. Therefore, it is possible to suppress a stripe in a formed image.

In the inkjet recording device according to another mode of the present invention, it is preferable that the consumption flow rate L2 is decided based on a formed image.

According to the inkjet recording device according to another mode of the present invention, by deciding the consumption flow rate L2 by the amount of ejection from the ejection head, it is possible to calculate the print time limit n before printing.

In the inkjet recording device according to another mode of the present invention, it is preferable that interruption of the printing is performed during a deaeration waiting time to complete deaeration of the ink.

According to the inkjet recording device according to another mode of the present invention, since printing is interrupted and printing restarts after the deaeration waiting time, it can be assumed that deaeration of ink in the ink tank is completed and ink of a small dissolved oxygen amount is provided, and therefore it is possible to suppress a stripe in a formed image.

In the inkjet recording device according to another mode of the present invention, it is preferable that, when the deaeration waiting time is assumed as Td (sec), a circulation amount to circulate from the ink tank to the ink tank through the ejection head is assumed as L0 (ml/sec), performance of the deaeration module is assumed as Dp (dimensionless parameter) and a total ink amount in the ink tank, the ejection head, the supply channel and the collection channel is assumed as V (ml), the deaeration waiting time is calculated by equation (2).

$$Td=V/(Dp\times L0) \quad (2)$$

According to the inkjet recording device according to another mode of the present invention, it is possible to calculate the deaerating waiting time by equation (2).

In the inkjet recording device according to another mode of the present invention, it is preferable that: a maintenance time to perform maintenance of the ejection head during the image formation is provided; and, by adjusting at least any one of supplement flow rate L1 into the ink tank and ink amount T in the ink tank, the print time limit n is made longer than time for the image formation during the maintenance.

According to the inkjet recording device according to another mode of the present invention, by adjusting supplement flow rate L1 and ink amount T in the ink tank of the initial state, it is possible to lengthen the print time limit n. By lengthening the print time limit n and setting it equal to or greater than the interval of image formation time during maintenance, it is possible to make the deaeration waiting time equal to the time for the maintenance of the ejection head. Therefore, in a case where the deaeration waiting time and the maintenance time are necessary, it is possible to shorten the total print time.

According to the inkjet recording device of the present invention, the number of papers on which printing is possible by deaerated ink and supplemented ink at the time of the image formation start, and, by performing deaeration during printing in a case where printing does not end, it is possible to form an image of high quality without the occurrence of stripes in the formed image.

DETAILED DESCRIPTION OF EXEMPLARY EMBODIMENTS

In the following, preferable embodiments of the present invention are described according to the accompanying drawings.

<<Entire Configuration of Inkjet Recording Device>>

Figure 1:
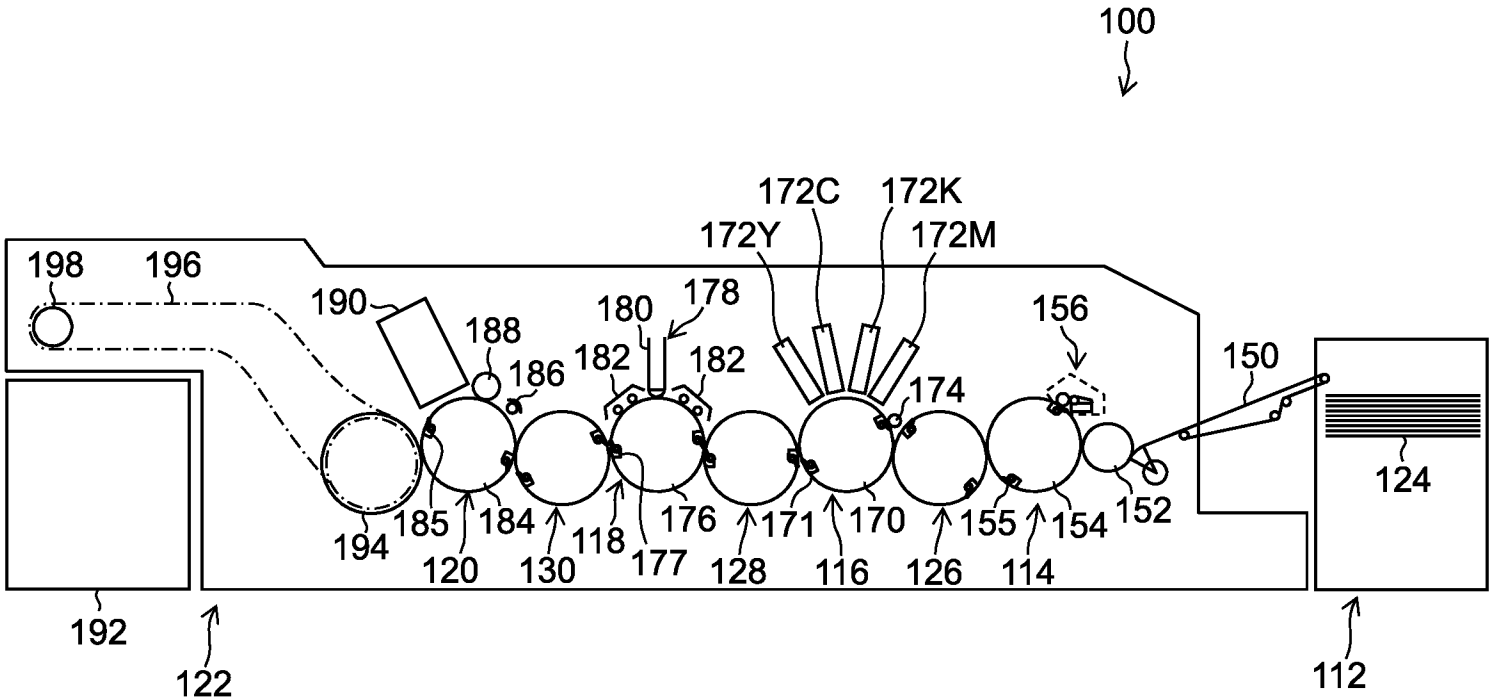
FIG. 1 is the entire configuration diagram of an inkjet recording device.

First, an inkjet recording device to which a liquid discharge device of the present invention is applied is described. FIG. 1 is a configuration diagram illustrating the entire configuration of an inkjet recording device according to the present invention.

This inkjet recording device 100 is an inkjet recording device of an impression cylinder direct-drawing system to form a desired color image by depositing ink of multiple colors from inkjet heads 172M, 172K, 172C and 172Y to a recording medium 124 (which may be referred to as "paper" for sake of convenience) held to an impression cylinder (drawing drum 170) of a drawing unit 116, which is an image formation device of an on-demand type to which a two-liquid reaction (coagulation) system to apply a processing liquid (a coagulation treatment liquid here) on the recording medium 124 before ink is deposited, make the processing liquid and an ink liquid react to each other and perform image formation on the recording medium 124 is applied.

As illustrated in the figure, the inkjet recording device 100 includes a paper feed unit 112, a processing liquid application unit 114, the drawing unit 116, a drying unit 118, a fixing unit 120 and a paper discharge unit 122.

(Paper Feed Unit)

The paper feed unit 112 is a mechanism that supplies the recording medium 124 to the processing liquid application unit 114, and the recording medium 124 that is a sheet is layered in the paper feed unit 112. A paper feed tray 150 is installed in the paper feed unit 112, and the recording medium 124 is fed from this paper feed tray 150 to the processing liquid application unit 114 one by one.

In the inkjet recording device 100 of this example, multiple kinds of recording media 124 of different paper types or sizes (paper sizes) can be used as the recording medium 124. Multiple paper trays (not illustrated) that classify and accumulate various kinds of recording media are installed in the paper feed unit 112, a mode in which a paper that is fed to the paper feed tray 150 is automatically switched among these multiple paper trays is possible, and a mode in which an operator selects or exchanges a paper tray according to the necessity is possible. Here, a sheet (cut sheet) is used as the recording medium 124 in this example, but a configuration in which a continuous paper (roll paper) is cut into a necessary size and fed is possible.

(Processing Liquid Application Unit)

The processing liquid application unit 114 is a mechanism that applies a processing liquid to the recording surface of the recording medium 124. The processing liquid includes a color material coagulant that coagulates a color material (pigment in this example) in ink applied in the drawing unit 116, and separation of the color material and a solvent in the ink is promoted when this processing liquid contacts with the ink.

As illustrated in FIG. 1, the processing liquid application unit 114 includes a feeding cylinder 152, a processing liquid drum 154 and an application device 156. The processing liquid drum 154 is a drum that holds the recording medium 124 and performs rotation conveyance. The processing liquid drum 154 includes pawl-shaped holding means (gripper) 155 on the outer peripheral surface and can hold the front end of the recording medium 124 by sandwiching the recording medium 124 between the pawl of this holding means 155 and the peripheral surface of the processing liquid drum 154. The processing liquid drum 154 may have an adsorption hole on the outer peripheral surface and connect with suction means for performing suction from the adsorption hole. By this means, it is possible to closely hold the recording medium 124 on the peripheral surface of the processing liquid drum 154.

On the outside of the processing liquid drum 154, the application device 156 is installed so as to be opposite to the peripheral surface thereof. The application device 156 includes an application plate in which a processing liquid is stored, an anilox roller (measurement roller) of which part is dipped in the processing liquid of this application plate, and a rubber roller (application roller) that is subjected to pressure welding by the anilox roller and the recording medium 124 on the processing liquid drum 154 and transfers a measured processing liquid to the recording medium 124. According to this application device 156, it is possible to apply the processing liquid to the recording medium 124 while measuring it.

The recording medium 124 to which the processing liquid is applied in the processing liquid application unit 114 is passed from the processing liquid drum 154 to the drawing drum 170 of the drawing unit 116 through a middle conveyance unit 126.

(Drawing Unit)

The drawing unit 116 includes the drawing drum (second conveyance body) 170, a paper press roller 174 and the inkjet heads 172M, 172K, 172C and 172Y. Similar to the processing liquid drum 154, the drawing drum 170 includes pawl-shaped holding means (gripper) 171 on the outer peripheral surface. The recording medium 124 fixed to the drawing drum 170 is conveyed such that the recording surface faces the outside, and ink is given from the inkjet heads 172M, 172K, 172C and 172Y to this recording surface.

It is preferable that each of the inkjet heads 172M, 172K, 172C and 172Y is assumed as a recording head (inkjet head) of an inkjet system of a full-line type with a length corresponding to the maximum width of an image formation region in the recording medium 124. A nozzle array in which multiple nozzles for ink ejection are arranged over the entire width of the image formation region is formed on the ink ejection surface. Each of the inkjet heads 172M, 172K, 172C and 172Y is installed so as to extend in a direction orthogonal to the conveyance direction of the recording medium 124 (the rotation direction of the drawing drum 170). When droplets of corresponding color ink are ejected from each of the inkjet heads 172M, 172K, 172C and 172Y to the recording surface of the recording medium 124 closely held on the drawing drum 170, the ink contacts with a processing liquid applied beforehand to the recording surface of the processing liquid application unit 114, and a color material (pigment) that disperses in the ink is coagulated to form a color material aggregate. By this means, a color material flow or the like on the recording medium 124 is prevented, and an image is formed on the recording surface of the recording medium 124.

Here, a configuration with standard colors of CMYK (four colors) is exemplified in this example, but a combination of ink colors and the color number is not limited to the present embodiment, and a light shade ink, a deep ink and a special color ink may be added according to the necessity. For example, a configuration in which inkjet heads that eject light system ink such as light cyan and light magenta are added is possible, and the arrangement order of respective color heads is not especially limited.

The recording medium 124 on which an image is formed in the drawing unit 116 is passed from the drawing drum 170 to a drying drum 176 of the drying unit 118 through a middle conveyance unit 128.

(Drying Unit)

The drying unit 118 is a mechanism that dries moisture included in a solvent separated by color material coagulant operation, and includes the drying drum 176 and a solvent drying device 178 as illustrated in FIG. 1.

Similar to the processing liquid drum 154, the drying drum 176 includes pawl-shaped holding means (gripper) 177 on the outer peripheral surface and can hold the front end of the recording medium 124 by this holding means 177.

The solvent drying device 178 includes multiple IR heaters 182 disposed in positions facing the outer peripheral surface of the drying drum 176, and a hot air ejection nozzle 180 disposed between respective IR heaters 182.

It is possible to realize various drying conditions by arbitrarily adjusting the temperature and air quantity of hot air blown from the hot air ejection nozzle 180 to the recording medium 124 and the temperature of respective IR heaters 182.

Moreover, the surface temperature of the drying drum 176 is set to 50° C. or more. Drying is promoted by heating the back surface of the recording medium 124, and it is possible to prevent image destruction at the time of fixing. Here, the upper limit of the surface temperature of the drying drum 176 is not especially limited, but it is preferable to be set to 75° C. or less (more preferably, 60° C. or less) from the viewpoint of the safety (prevention of burn by high temperature) of maintenance operation such as cleaning of ink attached to the surface of the drying drum 176.

By holding the recording surface of the recording medium 124 so as to face the outside (that is, in a state where the recording surface of the recording medium 124 is curved so as to be a convex side) and performing rotation conveyance on the outer peripheral surface of the drying drum 176, it is possible to prevent wrinkle and floating of the recording medium 124 from being generated and surely prevent drying unevenness due to these.

The recording medium 124 subjected to drying processing in the drying unit 118 is passed from the drying drum 176 to a fixing drum 184 of the fixing unit 120 through a middle conveyance unit 130.

(Fixing Unit)

The fixing unit 120 includes the fixing drum 184, a halogen heater 186, a fixing roller 188 and an inline sensor 190. Similar to the processing liquid drum 154, the fixing drum 184 includes pawl-shaped holding means (gripper) 185 on the outer peripheral surface and can hold the front end of the recording medium 124 by this holding means 185.

The recording medium 124 is conveyed by rotation of the fixing drum 184 such that the recording surface faces the outside, and this recording surface is subjected to preheating by the halogen heater 186, fixing processing by the fixing roller 188 and inspection by the inline sensor 190.

The halogen heater 186 is controlled at a predetermined temperature (for example, 180° C.). By this means, preheating of the recording medium 124 is performed.

The fixing roller 188 is a roller member to weld self-dispersion thermoplastic resin fine particles in ink by heating and pressurizing dried ink and film the ink, and it is configured so as to heat and pressurize the recording medium 124. Specifically, the fixing roller 188 is disposed so as to be subjected to pressure welding with respect to the fixing drum 184, and forms a nip roller with the fixing drum 184. By this means, the recording medium 124 is sandwiched between the fixing roller 188 and the fixing drum 184, nipped at a predetermined nip pressure (for example, 0.15 MPa) and subjected to fixing processing.

Moreover, the fixing roller 188 includes a heating roller that incorporates a halogen lamp in a metallic pipe such as conductive aluminum of good thermal conductivity, and is controlled at a predetermined temperature (for example, 60° to 80° C.). Thermal energy equal to or greater than the Tg temperature of thermoplastic resin fine particles contained in ink (glass transition point temperature) is given by heating the recording medium 124 by this heating roller, and the thermoplastic resin fine particles are melted. By this means, push-in fixing is performed on the asperity of the recording medium 124, the asperity of an image surface is subjected to leveling, and luster is obtained.

Moreover, a configuration in which only one fixing roller 188 is provided is adopted in the embodiment in FIG. 1, but a configuration in which a plurality of ones are provided according to the thickness of an image layer and the Tg characteristics of thermoplastic resin fine particles is possible.

Meanwhile, the inline sensor 190 is measurement means for measuring the check pattern, moisture amount, surface temperature and glossiness, and so on, of an image fixed to the recording medium 124, and a CCD line sensor or the like is applied.

According to the fixing unit 120 configured as above, since thermoplastic resin fine particles in an image layer that is a thin layer formed in the drying unit 118 are heated and pressurized by the fixing roller 188 and melted, it can be anchored and fixed to the recording medium 124. Moreover, when the surface temperature of the fixing drum 184 is set to 50° C. or more, drying is promoted by heating the back surface of the recording medium 124 held to the outer peripheral surface of the fixing drum 184, and it is possible to prevent image destruction at the time of fixing and improve image strength by a temperature rise effect of image temperature.

Moreover, in a case where a UV-curable monomer is contained in ink, by irradiating UV to an image by a fixing unit including a UV irradiation lamp after moisture is sufficiently volatilized in a drying unit, it is possible to harden and polymerize the UV-curable monomer and improve the image strength.

(Paper Discharge Unit)

As illustrated in FIG. 1, the paper discharge unit 122 is installed after the fixing unit 120. The paper discharge unit 122 includes a discharge tray 192, and a transfer barrel 194, a conveyance belt 196 and a stretching roller 198 are installed between this discharge tray 192 and the fixing drum 184 of the fixing unit 120 so as to touch these. The recording medium 124 is sent to the conveyance belt 196 by the transfer barrel 194 and discharged to the discharge tray 192.

Moreover, in addition to the above-mentioned components, the inkjet recording device 100 of this example includes an ink storage/loading unit that supplies ink to each of the inkjet heads 172M, 172K, 172C and 172Y and means for supplying a processing liquid to the processing liquid application unit 114 though they are not illustrated, and it includes a head maintenance unit that performs cleaning (wiping, purge and nozzle suction of a nozzle surface, and so on) of each of the inkjet heads 172M, 172K, 172C and 172Y, a position detection sensor that detects the position of the recording medium 124 in a paper conveyance path and a temperature sensor that detects the temperature of each unit of the device, and so on.

<<Description of Circulatory System of Inkjet Head>>

Figure 2:
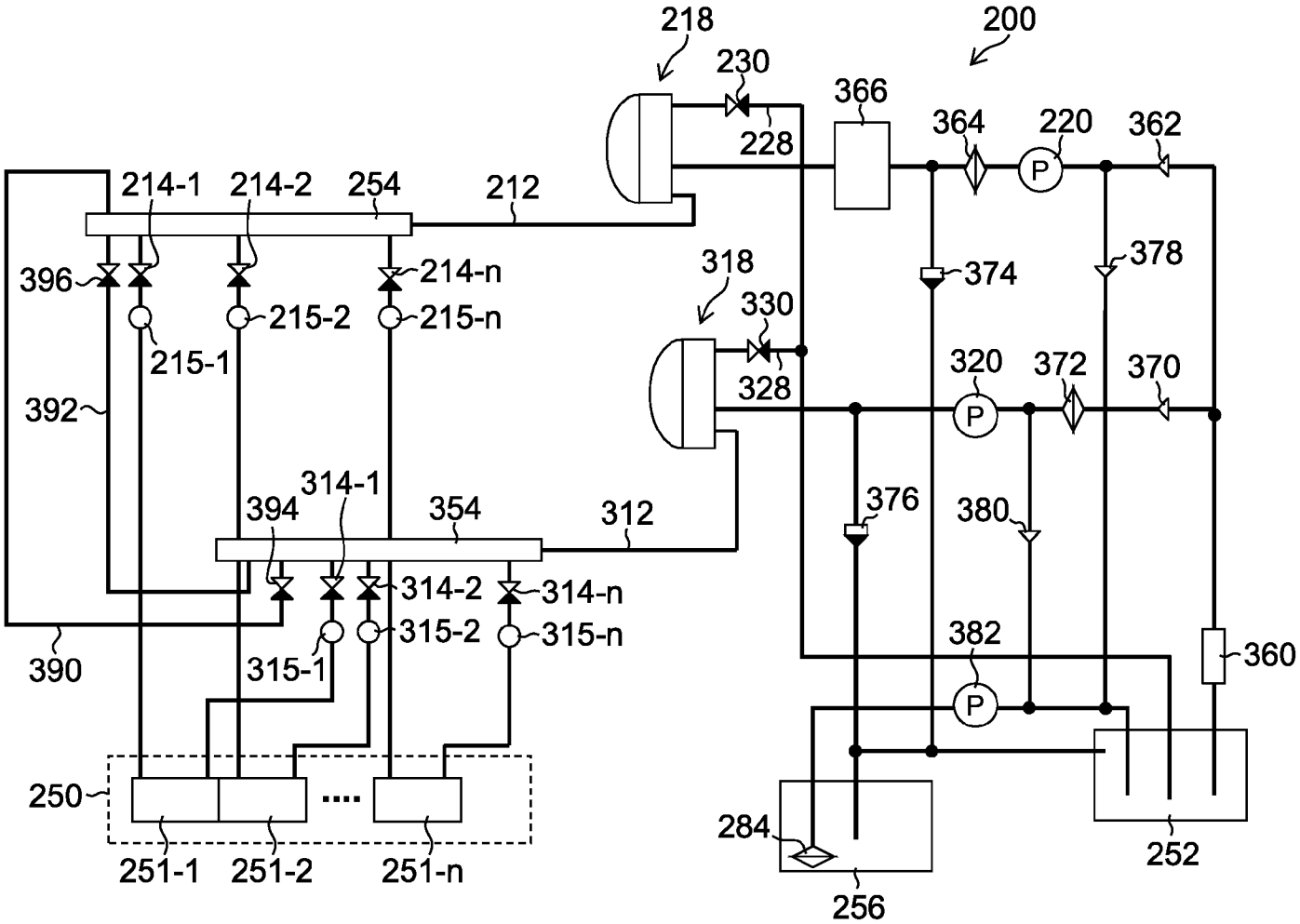
FIG. 2 is a block diagram illustrating a schematic configuration of a circulation-type ink supply device.

Next, the circulatory system of an inkjet recording device is described. FIG. 2 is a block diagram illustrating the outline of a circulation-type ink supply device.

(Entire Configuration)

An ink supply device 200 illustrated in this figure includes a supply channel 212 and a collection channel 312. A supply sub-tank 218 is installed in the supply channel 212, and a collection sub-tank 318 is installed in the collection channel 312. The supply sub-tank 218 is communicated with an ink tank 252 through a supply pump 220 and a predetermined ink channel, and the collection sub-tank 318 is communicated with the ink tank 252 through a collection pump 320 and a predetermined ink channel.

A head 250 (ejection head) illustrated in FIG. 2 is a head having a structure in which n head modules 251-1, 251-2, . . . , **251-*n* are connected, and the head modules 251 are communicated with the supply channel 212 through dampers 215-1, 215-2, . . . , 215-*n* and supply valves 214-1, 214-2, . . . , 214-*n* respectively, and communicated with the supply channel 212 through dampers 315-1, 315-2, . . . , 315-*n* and supply valves 314-1, 314-2, . . . , 314-*n***, respectively.

A supply-side manifold 254 is a temporary ink storage unit installed between the supply channel 212 and the head 250, and a collection-side manifold 354 is a temporary ink storage unit installed between the collection channel 312 and the head 250. The supply-side manifold 254 and the collection-side manifold 354 are communicated with each other by a first bypass channel 390 and a second bypass channel 392, and the first and second bypass channels 390 and 392 include a first bypass channel valve 394 and a second bypass channel valve 396 respectively.

As for the supply pump 220 and the collection pump 320, a tube pump is applied. The supply pump 220 controls the pressure (liquid supply amount) of the supply channel 212 that supplies ink from the ink tank (buffer tank) 252 to the head 250, and the collection pump 320 controls the pressure (liquid supply amount) of the collection channel 312 that collects (circulates) ink from the head 250 to the ink tank 252. As for the supply pump 220 and the collection pump 320, it is possible to apply pumps having the same performance (capacity).

The supply pump 220 and the collection pump 320 rotate only in one direction in a period in which the head 250 stops operating (that is, in a period in which ink stably flows), and, when the internal pressure decreases in a period in which the head 250 performs ejection operation, the supply pump 220 increases the rotational speed and the collection pump 320 reverses and raises the internal pressure of the head 250.

The supply sub-tank 218 has a structure divided into the liquid chamber and the air chamber by an elastic membrane having flexibility. When ink flows into the liquid chamber, the elastic membrane is transformed to the air chamber side according to the volume of the flowed ink. Meanwhile, since the volume of the ink flowed out from the liquid chamber does not vary, even if pressure fluctuation is caused in the supply channel 212, the pressure fluctuation is controlled by the operation of the supply sub-tank 218. That is, the supply sub-tank 218 has a pressure adjustment function that suppresses the internal pressure variation of the head 250 and the internal pressure variation of the supply channel 212 by pulsating flow by the operation of the supply pump 220. Moreover, the liquid chamber is communicated with the ink tank 252 through a drain channel 228 and a drain valve 230. Here, the collection sub-tank 318 has a configuration similar to the supply sub-tank 218 and is communicated with the ink tank 252 through a drain channel 328 and a drain valve 330.

In the ink supply device 200 illustrated in FIG. 2, a deaeration module 360 and a one-way valve 362 to prevent the backward flow of ink are installed between the ink tank 252 and the supply pump 220, and a filter 364 and a heat exchanger (cooling heating device) 366 are installed between the supply pump 220 and the supply sub-tank 218. Ink sent from the ink tank 252 is subjected to deaeration processing by the deaeration module 360, subjected to the removal of air bubbles and foreign objects by the filter 364, subjected to temperature adjustment processing by the heat exchanger 366 and thereafter sent to the supply sub-tank 218.

Moreover, a one-way valve 370 to prevent the backward flow of ink is installed between the deaeration module 360 and the collection pump 320 and a filter 372 is installed between them, and, even in a case where ink is sent from the ink tank 252 to the collection sub-tank 318, predetermined deaeration processing and filter processing are applied.

In addition, safety valves (relief valves) 374 and 376 are installed in the ink supply device 200, and, in a case where abnormality occurs in the supply pump 220 and the collection pump 320 and the internal pressures of the supply channel 212 and the collection channel 312 become greater than a predetermined value, the safety valves 374 and 376 operate and decrease the internal pressures of the supply channel 212 and the collection channel 312. Moreover, one-way valves 378 and 380 to prevent the backward flow of ink when the supply pump 220 and the collection pump 320 are reversely operated are installed.

In a main tank 256 illustrated in FIG. 2, ink supplied to the ink tank 252 is stored. When the amount of ink in the ink tank 252 decreases, a supplement pump 382 is operated and ink in the main tank 256 is sent to the ink tank 252. In the main tank 256, a filter 284 is internally installed. A liquid level sensor (not illustrated) is installed inside the ink tank 252, and, when ink in the ink tank 252 falls below the liquid level sensor, ink is supplied from the main tank 256 to the ink tank 252.

(Explanation of Circulation)

The ink supply device 200 having such a configuration operates the supply pump 220 and the collection pump 320, sets a differential pressure between the supply-side manifold 254 and the collection-side manifold 354, and circulates ink. For example, the supply pump 220 is normally operated to cause a negative pressure in the supply-side manifold 254 in a state where the supply valve 214 and the collection valve 314 are opened, while, when the collection pump 320 is reversely operated to cause a more negative pressure in the collection-side manifold 354 than the supply side, it is possible to flow ink from the supply-side manifold 254 to the collection-side manifold 354 through the head 250 and moreover circulate ink through the collection channel 312 and the collection sub-tank 318, and so on.

When the ink is circulated, the second bypass channel valve 396 installed in the second bypass channel 392 may be opened, and the supply-side manifold 254 and the collection-side manifold 354 may be communicated with each other through the second bypass channel 392. Here, if the bypass channels 390 and 392 have a diameter in which pressure loss is not caused at the time of pressurization, any one of them may be included.

<<Description of Ink Supply Control at Image Formation>>

First Embodiment

Figure 3:
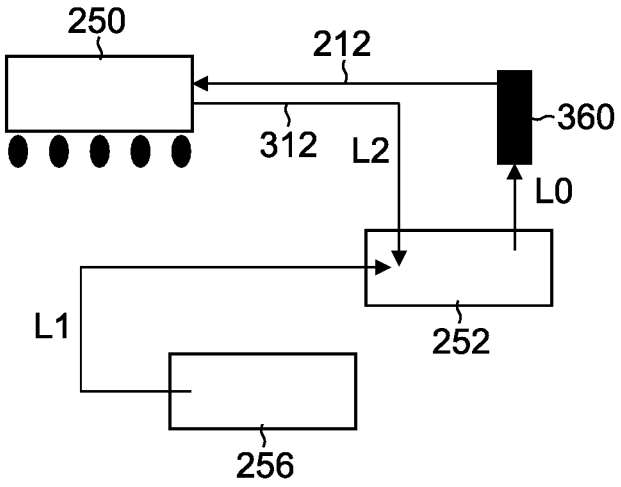
FIG. 3 is a schematic diagram that simplifies the circulation-type ink supply device illustrated in FIG. 2.

Next, ink supply control at image formation is described. FIG. 3 is a schematic diagram that illustrates by simplifying illustrates the ink circulation channel illustrated in FIG. 2. As mentioned above, in the present embodiment, ink is supplied from the ink tank 252 to the head 250, and ink that is not ejected is collected and returned to the ink tank 252. Moreover, ink decreased by the ejection is supplemented from the main tank 256.

It is preferable that ink whose dissolved oxygen amount in the ink is maintained at a low level is used as ink used for image formation. By using the ink whose dissolved oxygen amount is maintained at a low level, it is possible to suppress a stripe of a formed image and form an image of high quality.

In the initial state before image formation, ink filled in the ink tank 252 passes through the supply channel 212, and, by returning it from the collection channel 312 to the ink tank 252 through the deaeration module 360, a supply-side manifold 254, bypass channels 390 and 392 and the collection-side manifold 354, the deaeration of ink is performed. That is, the dissolved oxygen amount in the ink is maintained at a low level around 15%.

In the initial state (before printing starts), storage for ink tank capacity margin T (ml) is performed in the ink tank 252. When printing starts, ink is supplied from the ink tank 252 to the head 250, and the ink is ejected by the head 250. When printing proceeds, ink in the ink tank 252 is consumed and the amount of ink in the ink tank 252 falls below lower limit value $T_0$ in the ink tank 252 (when it is consumed by ΔT), ink is supplemented at a constant flow rate from the main tank 256 into the ink tank 252. Detection of ink amount T0 in the ink tank 252 to which ink is supplied is performed by the liquid level sensor.

When the supplement flow rate of ink from the main tank 256 to the ink tank 252 at this time is assumed as L1 (ml/sec) and the average consumption flow rate according to printing is assumed as L2 (ml/sec), since the supplement flow rate from the main tank 256 to the ink tank 252 is greater than the consumption amount of ink in the ink tank 252 in the case of L1>L2, the ink amount in the ink tank 252 increases and the supplement of ink from the main tank 256 stops at upper limit value $T_{max}$ in the ink tank 252. To eject ink from the head 250, deaeration is performed in the deaeration module 360 when ink is supplied and collected, and, since deaerated ink is stored in the ink tank 252, it is possible to perform printing by ink of a small dissolved oxygen amount.

Next, the case of L1<L2 is described. In this case, since the supplement flow rate from the main tank 256 to the ink tank 252 is less than the consumption amount of ink, ink in the ink tank 252 gradually decreases from $T_0$ at which the supply of ink from the main tank 256 starts. Therefore, since the amount of ink supplemented from the main tank 256 increases, the ink in the ink tank 252 gradually becomes ink of a large dissolved oxygen amount. Since an image in which a stripe occurs is provided when printing is performed with such ink of a large dissolved oxygen amount, print time limit n is provided in the present embodiment, and, by interrupting printing and deaerating ink in the ink tank 252 in a case where this print limit time n is exceeded in the printing, the dissolved oxygen amount of ink in the ink tank 252 is suppressed to a low level.

Print time limit n is calculated by the following equation.

$$n \leq (\Delta T/L2)+[T_0/(L2-L1)] \quad (1)$$

Here, consumption flow rate L2 denotes an average consumption flow rate in an image formation time, and it can be calculated before image formation, on the basis of a formed image. Moreover, supplement flow rate L1 from the main tank 256 denotes a fixed rate of supply from the main tank 256 when the liquid level sensor installed in the ink tank 252 finds that the ink amount in the ink tank 252 falls below lower limit value $T_0$.

In equation (1), (ΔT/L2) designates a print time before the supplement of ink from the main tank 256 to the ink tank 252 starts. $[T_0/(L2-L1)]$ designates a print time until $T_0$ is consumed after supplement from the main tank 256 to the ink tank 252 starts. That is, equation (1) indicates time to consume ink in the ink tank 252 in the initial state before printing starts. When at least sufficiently deaerated ink of the initial state is included in ejected ink, it can be assumed that the deaeration degree of ink in the ink tank is within a predetermined range (it is preferable to be 15% or less, and it is more preferable to be 9% or less), and it is possible to form an image in which a stripe is less likely to occur. Moreover, by providing print time limit n that satisfies equation (1), in the initial state, it is possible to interrupt printing in a state where ink exists in the ink tank 252. Therefore, since it is possible to interrupt printing in a state where the dissolved oxygen amount is maintained at a low level, it is possible to form a high-quality image in which the occurrence of a stripe of a formed image is suppressed.

Moreover, in equation (1), time required to exhaust ink in the ink tank 252 of the initial state is assumed to be print time limit n, but it is preferable to interrupt printing in a state where initial ink of a predetermined amount remains. It is preferable that the amount of ink in the ink tank 252 at the time of interruption of printing is 20% of the capacity of the ink tank 252, and it is more preferable that it is 30%.

In a case where print time limit n calculated by equation (1) is exceeded, deaeration is performed during printing. A deaeration waiting time when deaeration is performed is set to be equal to or greater than the time to complete the deaeration. Deaeration waiting time Td (sec) can be calculated by following equation (2). When circulation amount L0 (ml/sec) and deaeration module performance Dp (dimensionless) are assumed and total ink amount V (ml) in the ink tank 252, the head 250, the supply channel 212 and the collection channel 312 is assumed, it is as follows:

$$Td=V/(DpL0) \quad (2)$$

By assuming the deaeration waiting time to be equation (2), it is possible to perform deaeration of ink in the ink tank 252. The deaeration is performed through the deaeration module 360, and it is performed by making ink in the ink tank 252 circulate in the head 250. As for the circulation of ink, the deaeration can be substantially finished by performing the circulation twice, and, for example, it can be finished in about three minutes.

Second Embodiment

Next, ink supply control at image formation according to the second embodiment is described. By increasing supplement flow rate L1 from the main tank 256 to the ink tank 252 and an amount for ink tank capacity margin T, it is possible to lengthen print time limit n. By lengthening the time of print time limit n, it is possible to set the deaeration waiting time to the same time as the maintenance time between print jobs. By setting the deaeration waiting time to the same time as the maintenance time between print jobs, it is possible to decrease the total time of printing.

Moreover, print time limit n can be changed by changing the position of the liquid level sensor, that is, the amount of $T_0$. By setting the position of the liquid level sensor to be high, since it is possible to supplement ink from the main tank in the early stage after printing starts, it is possible to lengthen print time limit n.

Example

Figure 4A:
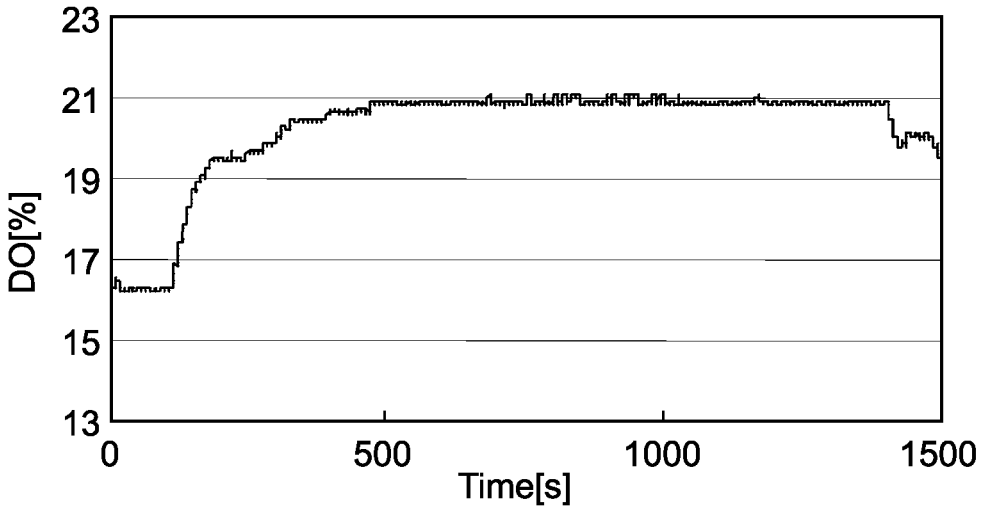
FIG. 4A is a graph diagram illustrating a change in a dissolved oxygen amount with respect to time by a printing method in the related art.
Figure 4B:
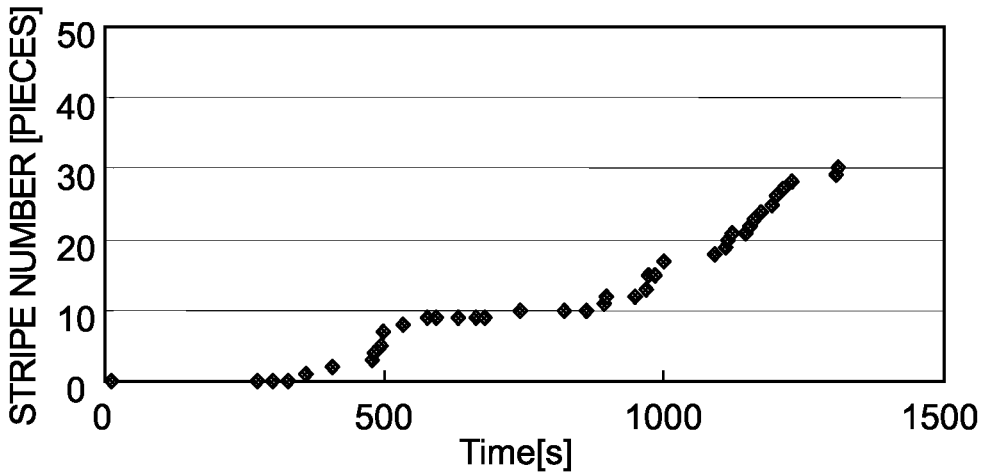
RELATED ART FIG.4B
FIG. 4B is a graph diagram illustrating a change in the stripe number of an image formed by a printing method in the related art.
Figure 5A:
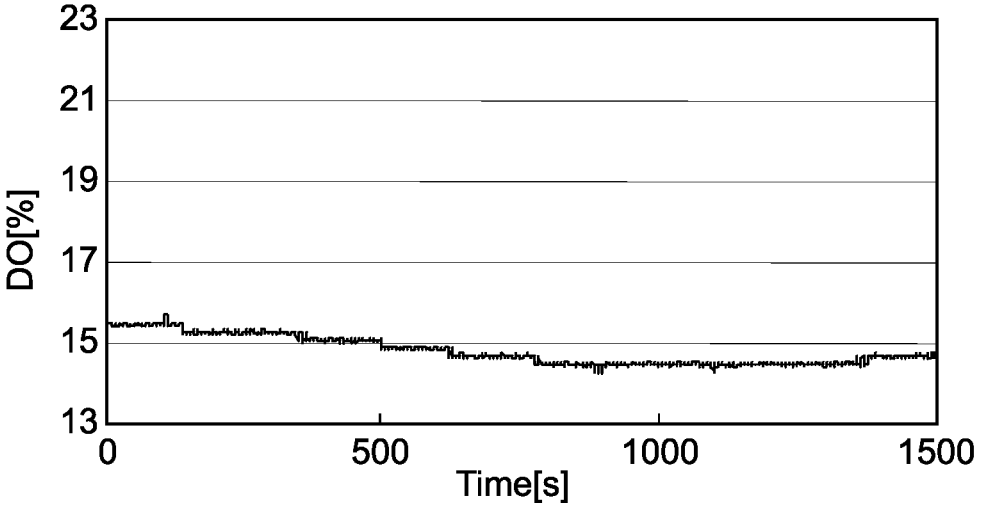
FIG. 5A is a graph diagram illustrating a change in a dissolved oxygen amount with respect to time by a printing method of the present embodiment.
Figure 5B:
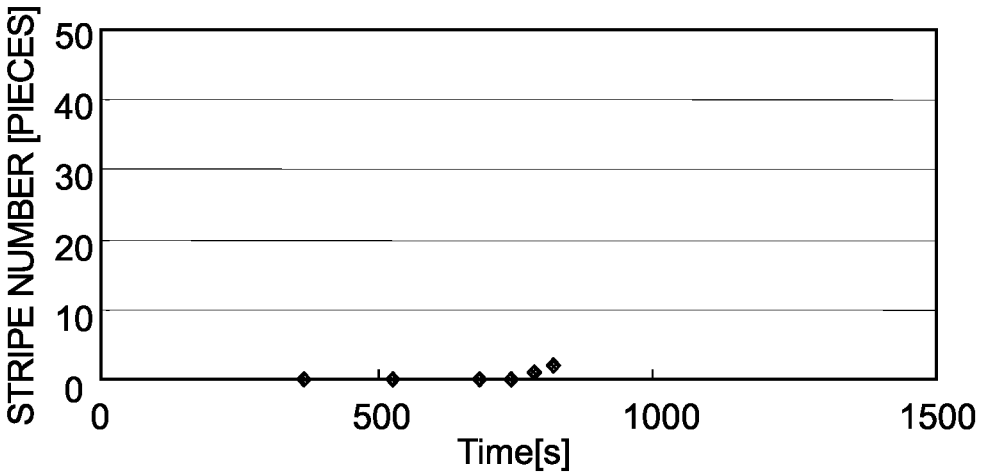
FIG. 5B is a graph diagram illustrating a change in the stripe number of an image formed by a printing method of the present embodiment.

FIGS. 4A to 5B are diagrams illustrating the relationship between a change in the dissolved oxygen amount and the number of stripes in the present embodiment and the related art. FIG. 4A is a graph illustrating a change in the dissolved oxygen amount by printing in the related art, and FIG. 4B illustrates a change in the number of stripes with respect to FIG. 4A. Moreover, FIG. 5A illustrates a change in the dissolved oxygen amount by printing in the present embodiment, and FIG. 5B illustrates a change in the number of stripes with respect to FIG. 5A.

As illustrated in FIGS. 4A and 4B, the dissolved oxygen amount increases when printing continues in the related art. It is possible to confirm that the number of stripes in a printed image increases according to an increase in the dissolved oxygen amount. According to FIGS. 4A and 4B, it is possible to confirm that the number of stripes increases when the dissolved oxygen amount is 20% or more.

By contrast with this, in the present invention, printing is interrupted with print time limit n as an upper limit such that ink of a large dissolved oxygen amount, which is supplied from the main tank 256, is not used for image formation. Therefore, as illustrated in FIG. 5A, it is possible to suppress an increase in the dissolved oxygen amount. By suppressing an increase in the dissolved oxygen amount, as illustrated in FIG. 5B, it is possible to confirm that the number of stripes in a formed image decreases and an image of high quality can be formed.

<<Control System>>

Figure 6:
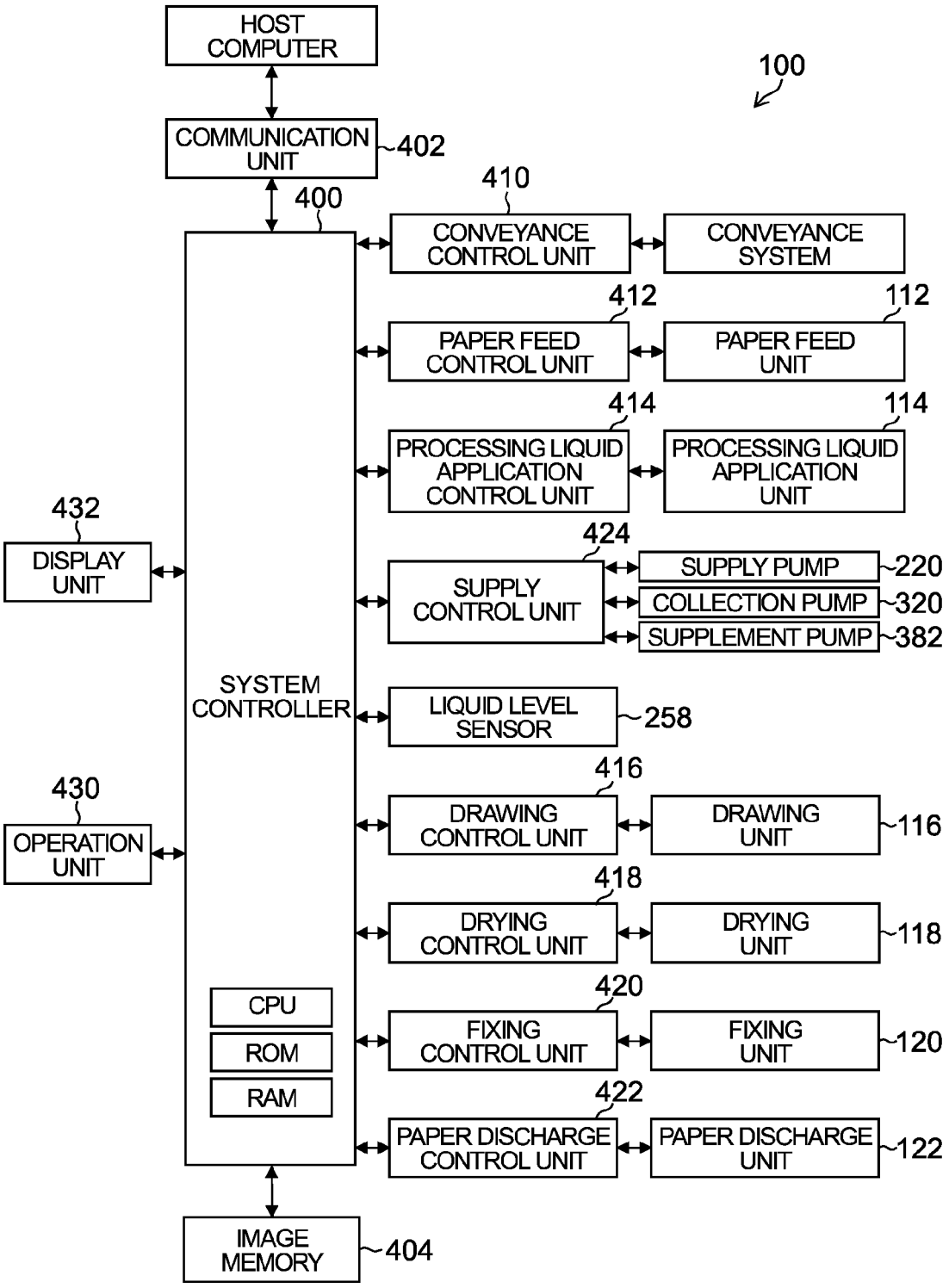
FIG. 6 is a block diagram of a control system of an inkjet recording device.

FIG. 6 is a block diagram illustrating the schematic configuration of a control system of the inkjet recording device 100 of the present embodiment.

As illustrated in the figure, the inkjet recording device 100 includes a system controller 400, a communication unit 402, an image memory 404, a conveyance control unit 410, a paper feed control unit 412, a processing liquid application control unit 414, a drawing control unit 416, a drying control unit 418, a fixing control unit 420, a paper discharge control unit 422, an operation unit 430 and a display unit 432.

The system controller 400 functions as control means for controlling each unit of the inkjet recording device 100 in an integral manner and functions as operation means for performing various kinds of operation processing. This system controller 400 includes a CPU, a ROM and a RAM, and performs operation according to a predetermined control program. The ROM includes a control program executed by this system controller 400 and various kinds of data required for control.

The communication unit 402 includes a necessary communication interface, and transmits and receives data between the communication interface and a connected host computer.

The image memory 404 functions as temporary storage means of various kinds of data including image data, and reads and writes data through the system controller 400. Image data imported from the host computer through the communication unit 402 is stored in this image memory 404.

The conveyance control unit 410 controls the conveyance system of a recording medium in the inkjet recording device 100. That is, it controls the drive of the feeding cylinder 152 and the processing liquid drum 154 in the processing liquid application unit 114, the drawing drum 170 in the drawing unit 116, the drying drum 176 in the drying unit 118 and the fixing drum 184 in the fixing unit 120, and controls the drive of the middle conveyance units 126, 128 and 130.

The conveyance control unit 410 controls a conveyance system according to an instruction from the system controller 400, and performs control such that the recording medium 124 is conveyed from the paper feed unit 112 to the paper discharge unit 122 without delay.

The paper feed control unit 412 controls the paper feed unit 112 according to an instruction from the system controller 400 and performs control such that the recording medium 124 is sequentially fed one by one without overlap.

The processing liquid application control unit 414 controls the processing liquid application unit 114 according to an instruction from the system controller 400. Specifically, the drive of the application device 156 is controlled such that a processing liquid is applied to a recording medium conveyed by the processing liquid drum (impression cylinder) 154.

The drawing control unit 416 controls the drawing unit 116 according to an instruction from the system controller 400. Specifically, the drive of the inkjet heads 172M, 172K, 172C and 172Y is controlled such that a predetermined image is recorded in a recording medium conveyed by the drawing drum 170. Moreover, printing is interrupted before print time limit n passes.

The supply control unit 424 controls the drive of the supply pump 220 and the collection pump 320, supplies ink from the ink tank 252 to the inkjet heads 172M, 172K, 172C and 172Y, and collects ink into the ink tank 252. Moreover, ink is circulated through the supply channel 212 and the collection channel 312 when the deaeration of ink in the ink tank 252 is performed.

Moreover, the supplement pump 382 is controlled on the basis of a liquid level sensor 258 installed in the ink tank 252. The supplement pump 382 is driven when the liquid level of ink in the ink tank 252 becomes equal to or less than a set lower limit value, and ink is supplemented from the main tank 256. Moreover, when the liquid level of ink in the ink tank 252 becomes a set upper limit value, the drive of the supplement pump 382 is stopped and the supplement of ink is discontinued.

The drying control unit 418 controls the drying unit 118 according to an instruction from the system controller 400. Specifically, it controls the drive of the solvent drying device 178 such that the recording medium 124 conveyed by the drying drum 176 is dried by an IR heater 182 and the hot air ejection nozzle 180.

The fixing control unit 420 controls the fixing unit 120 according to an instruction from the system controller 400. Specifically, it controls the drive of the halogen heater 186 and the fixing roller 188 such that a recording medium conveyed by the fixing drum 184 is heated and pressurized. Moreover, it controls the operation of the inline sensor 190 such that a fixed image is read.

The paper discharge control unit 422 controls the paper discharge unit 122 according to an instruction from the system controller 400. Specifically, it controls the drive of the transfer barrel 194, the conveyance belt 196 and the stretching roller 198, and so on, and performs control such that the recording medium 124 is stacked in the discharge tray 192.

The operation unit 430 includes necessary operation means (for example, an operation button, a keyboard and a touch panel, and so on), and outputs operation information input from the operation means to the system controller 400. The system controller 400 performs various kinds of processing according to the operation information input from this operation unit 430.

The display unit 432 includes a necessary display device (for example, an LCD panel, and so on), and displays necessary information on the display device according to an instruction from the system controller 400.

As mentioned above, image data recorded in the recording medium 124 is imported in the inkjet recording device 100 from the host computer through the communication unit 402. The imported image data is stored in the image memory 404. The system controller 400 performs necessary signal processing on the image data stored in this image memory 404 and generates dot data. Further, it controls the drive of respective inkjet heads 172M, 172K, 172C and 172Y of the drawing unit 116 according to the generated dot data, and records an image that shows the image data in a paper.

The dot data is generated by generally performing color conversion processing and halftone processing on the image data. The color conversion processing is processing to convert image data expressed by sRGB or the like (for example, RGB 8-bit image data) into ink amount data of each color of ink used in the inkjet recording device 100 (in this example, conversion into ink amount data of each color of M, K, C and Y). The halftone processing is processing to perform processing such as error diffusion on the ink amount data of each color generated by the color conversion processing and convert it into dot data of each color.

The system controller 400 generates the dot data of each color by performing the color conversion processing and the halftone processing on image data. Further, by controlling the drive of a corresponding inkjet head according to the generated dot data of each color, an image shown by the image data is recorded in a paper.

What is claimed is:

1. An inkjet recording device comprising:

an ejection head in which an ejection port to eject ink is formed;

an ink tank which is connected with the ejection head through a supply channel and a collection channel and houses the ink supplied to the ejection head through the supply channel and collected from the ejection head through the collection channel;

a deaeration module which is provided on a side of the supply channel and deaerates the ink;

a main tank which is connected with the ink tank through a supplement channel and in which the ink supplied to the ink tank through the supplement channel is stored;

a liquid level sensor which is provided in the ink tank and detects ink in the ink tank;

a supply control unit which controls supply and collection of the ink; and a drawing control unit which controls ejection of the ink and performs image formation, wherein:

the supply control unit supplements the ink from the main tank to the ink tank at supplement flow rate L1 (ml/sec) when the liquid level sensor detects that an ink amount in the ink tank is equal to or less than a lower limit value, and the supply control unit interrupts supplement of the ink when the ink amount in the ink tank becomes an upper limit value;

a consumption flow rate of the ink ejected from the ejection head is assumed as L2 (ml/sec), an amount of the ink in the ink tank before a start of printing is assumed as T (ml), an ink amount of a lower limit value detected by the liquid level sensor in the ink tank is assumed as $T_0$ (ml), a used amount up to detection in the liquid level sensor from amount T of the ink in the ink tank before the start of printing is assumed as $\Delta T$ ($=T-T_0$) (ml), and, in a case of $L1<L2$, print time limit n (sec) is calculated by equation (1), $$n \leq (\Delta T/L2)+[T_0/(L2-L1)] \quad (1); \text{ and}$$

when printing does not end within the print time limit n, the printing is interrupted within the print time limit n, and the ink is deaerated by circulating the ink between the ink tank and the ejection head.

2. The inkjet recording device according to claim 1, wherein the consumption flow rate L2 is decided based on a formed image.

3. The inkjet recording device according to claim 1, wherein interruption of the printing is performed during a deaeration waiting time to complete deaeration of the ink.

4. The inkjet recording device according to claim 3, wherein, when the deaeration waiting time is assumed as Td (sec), a circulation amount to circulate from the ink tank to the ink tank through the ejection head is assumed as L0 (ml/sec), performance of the deaeration module is assumed as Dp and a total ink amount in the ink tank, the ejection head, the supply channel and the collection channel is assumed as V (ml), the deaeration waiting time is calculated by equation (2)

$$Td=V/(Dp\times L0) \quad (2)$$

5. The inkjet recording device according to claim 1, wherein:

a maintenance time to perform maintenance of the ejection head during the image formation is provided; and by adjusting at least any one of supplement flow rate L1 in the ink tank and ink amount T in the ink tank, the print time limit n is made longer than time for the image formation during the maintenance.

* * * * *